US009396686B2

(12) United States Patent
Ito et al.

(10) Patent No.: US 9,396,686 B2
(45) Date of Patent: Jul. 19, 2016

(54) DISPLAY DEVICE

(75) Inventors: Tadayuki Ito, Tokyo (JP); Yoshihito Mochizuki, Tokyo (JP); Naoki Itakura, Tokyo (JP); Yasuki Sato, Tokyo (JP); Kiyofumi Natori, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 14/368,841

(22) PCT Filed: Jan. 4, 2012

(86) PCT No.: PCT/JP2012/050022

§ 371 (c)(1),
(2), (4) Date: Jul. 11, 2014

(87) PCT Pub. No.: WO2013/102997

PCT Pub. Date: Jul. 11, 2013

(65) Prior Publication Data

US 2015/0206482 A1 Jul. 23, 2015

(51) Int. Cl.
*G09G 3/34* (2006.01)
*G09F 13/00* (2006.01)

(52) U.S. Cl.
CPC ..... *G09G 3/3406* (2013.01); *G09F 13/005* (2013.01); *G09G 2320/0626* (2013.01); *G09G 2320/0633* (2013.01); *G09G 2360/145* (2013.01)

(58) Field of Classification Search
CPC ..... G06F 3/0412; G06F 3/044; G06F 2203/04103; G09G 2320/0626; G09G 2320/0633; G09G 2320/064; G09G 2320/0646; G09G 2320/0233; G09G 2360/14; G09G 2360/141; G09G 2360/142; G09G 2360/145; G09G 2360/147; G09G 2360/148
See application file for complete search history.

(56) References Cited

U.S. PATENT DOCUMENTS 7,288,896 B2 * 10/2007 Edelbrock ..... G09G 3/3406 315/149
2004/0095402 A1 * 5/2004 Nakano ..... G06F 3/0412 346/102
2006/0214174 A1 * 9/2006 Shirakuma ..... G09G 3/3413 257/89
2009/0224678 A1 * 9/2009 Wang ..... G09G 3/3426 315/158
2009/0315816 A1 * 12/2009 Choi ..... G02F 1/13338 345/82
2010/0085338 A1 * 4/2010 Miguchi ..... G02F 1/133609 345/207
2010/0156755 A1 * 6/2010 Chou ..... G06F 3/1423 345/1.1
2010/0259555 A1 * 10/2010 Hibi ..... G09G 3/3611 345/601
2010/0289784 A1 * 11/2010 Fujioka ..... G02F 1/13338 345/207

(Continued)

FOREIGN PATENT DOCUMENTS

EP 1 619 540 A1 1/2006
JP 2001-265296 A 9/2001

(Continued)

OTHER PUBLICATIONS

International Search Report in PCT/JP2011/080235 dated Feb. 21, 2012 (English Translation Thereof).

(Continued)

*Primary Examiner* — Tom Sheng
(74) *Attorney, Agent, or Firm* — McGinn IP Law Group, PLLC

(57) ABSTRACT

A display device includes a display panel body that has a display surface emitting light, and a brightness sensor unit that is fixed on the display surface of the display panel body and includes a brightness sensor detecting a brightness of the light from the display surface.

5 Claims, 5 Drawing Sheets

(56) References Cited

U.S. PATENT DOCUMENTS

| | | | | |
|---|---|---|---|---|
| 2011/0141060 | A1* | 6/2011 | Kim | G06F 3/0412 345/175 |
| 2011/0181566 | A1* | 7/2011 | Chifu | G01J 1/02 345/207 |
| 2011/0304532 | A1* | 12/2011 | Suh | G09G 3/3406 345/156 |
| 2012/0162126 | A1* | 6/2012 | Yuan | G06F 3/0412 345/174 |

FOREIGN PATENT DOCUMENTS

| | | | |
|---|---|---|---|
| JP | 2004-163479 | A | 6/2004 |
| JP | 2010-141239 | A | 6/2010 |
| JP | 2011-39311 | A | 2/2011 |
| JP | 2011-227424 | A | 11/2011 |
| WO | WO 2004/097510 | A1 | 11/2004 |
| WO | WO 2007/043620 | A1 | 4/2007 |
| WO | WO 2011/048853 | A1 | 4/2011 |

OTHER PUBLICATIONS

Japanese Office Action dated Nov. 4, 2015 issued in counterpart Japanese Application No. 2013-552360 with an English translation thereof.

* cited by examiner

DISPLAY DEVICE

TECHNICAL FIELD

The present invention relates to the display unit which includes a brightness sensor that detects the luminance of a display panel.

BACKGROUND ART

Some display devices that are utilized as monitors of various electronic devices have a function that automatically adjusts the brightness of the display surface. Such a display device detects the brightness of the display surface with a brightness sensor, and a controller automatically controls, based on the detected brightness, a drive circuit of the display surface so as to put the brightness of the display surface in a preset range.

In the display device, a display panel that includes a liquid crystal display panel or the like and a drive circuit that drives the display panel are housed in a housing of the display device. An opening that exposes the display surface of the display panel is formed in the housing, and a frame that blocks the gap between the outer periphery of the display panel and the housing is provided at the opening.

For example, Patent Document 1 discloses a display device in which a brightness sensor is installed on a frame that is positioned at the outer periphery of the display surface. Thereby, the brightness sensor detects the brightness of a specified position where a display pattern for brightness detection is displayed on the display surface.

PRIOR ART DOCUMENT

Patent Document

[Patent Document 1] PCT International Publication NO. WO 2004/097510

SUMMARY OF THE INVENTION

Problem to be Solved by the Invention

However, relative displacement (shifting) between the display panel and the frame that is provided at the opening portion of the housing can occur due to heat that is produced during driving of the display panel and temperature changes based on the external environment, as well as vibration that is applied from outside.

When this displacement occurs in the X-Y directions along the display surface of the display panel, since the brightness sensor that is fixed on the frame also undergoes positional shifting on the display surface, the position at which brightness is detected by the brightness sensor shifts from the specified position. The region to be inspected on the display surface by the brightness sensor is a special image for inspection that is arranged at a position that cannot be seen from the viewer. When positional shifting of the brightness sensor occurs, variations arise in the brightness being detected, leading to a drop in the brightness detection accuracy and the brightness automatic adjustment performance.

In contrast, if the surface area of the inspection region where the display pattern is shown on the display surface is set to be greater than the detection region by the brightness sensor, even if relative displacement between the display panel and the frame occurs due to heat or vibration, it is considered possible for brightness detection to always be carried out by the brightness sensor within the range of the specified location.

However, since the surface area of the inspection region required for brightness detection increases on the display surface as a result, there is a problem of the information display area such as the effective image being restricted.

Moreover, besides shifting in the X-Y directions along the display surface, relative displacement of the display panel and the frame also includes shifting in the Z direction perpendicular to the display surface. When the distance between the brightness sensor and the display surface fluctuates in the Z direction that is perpendicular to the surface of the display surface, since the brightness that is detected by the brightness sensor fluctuates in accordance with the square of the distance between the brightness sensor and the display surface, it is undesirable for the brightness sensor to be affected by fluctuations of the display panel and the frame in a direction perpendicular to the surface of the display surface.

While it is conceivable to increase the rigidity of the display panel and the frame, and increase the rigidity of the fixtures that support the brightness sensor, doing so leads to such disadvantages as an enlargement of the display device, an increase in weight, and a reduction in the information display area as the fixtures increase in size.

The present invention has been achieved in view of the above issues, and has as its exemplary object to provide a display device that is capable of stably performing highly accurate detection of brightness of the display surface by a brightness sensor, without being affected by temperature changes and the like of the display device.

Means for Solving the Problem

The present invention adopts the following means in order to solve the aforementioned issues.

Namely, the display device of the present invention includes: a display panel body; and a brightness sensor unit that is fixed on a display surface of the display panel body, and includes a brightness sensor detecting a brightness of the display panel body.

According to the present invention, the brightness sensor unit having the brightness sensor is fixed on the display surface of the display panel body. Therefore, even if the display panel body and the frame undergo deformation and displacement due to temperature, drive heat, vibration and the like, it is possible to detect by the brightness sensor with a high degree of accuracy the brightness of the display surface since there is no shifting of the brightness sensor from a predetermined region of the display surface, that is to say, from the region to be inspected.

Also, the brightness sensor unit may include: a sensor holder that is made of a light transmissive material, the sensor holder including an adhesion surface adhered to the display surface of the display panel body and a light diffusing portion diffusing light from the display panel body; and the brightness sensor that is fixed to a position facing the display surface with sandwiching the light diffusing portion of the sensor holder therebetween.

Since it is possible to diffuse the light radiated from the display surface by the light emitted from the display surface of the display panel body reaching the brightness sensor via the sensor holder, and moreover passing through the light diffusing portion of the sensor holder, stable brightness measurements can be performed with the brightness sensor.

Also, the light diffusing portion may be formed by a surface opposing the adhesion surface being subjected to an irregularity treatment. Alternatively, the light diffusing portion may be a light diffusing member that contains a light diffusing material.

In either case, since the light from the display panel body is diffused by the light diffusing portion and then received by the brightness sensor, it is possible to detect stable brightness.

Also, it is preferable that the sensor holder includes a base portion in which a housing cavity housing the brightness sensor is formed, and the light diffusing portion is provided on an inner surface of the housing cavity, the inner surface opposing the brightness sensor.

The light from the display panel body can be received by the brightness sensor that is provided in the housing cavity after being diffused by the light diffusing portion.

Also, it is preferable that the sensor holder has a non-contact structure with a frame and a bezel provided at an outer periphery of the display panel body.

With this kind of constitution, even if the frame and the bezel undergo thermal expansion and contraction due to driving heat of the display panel, the temperature of the surrounding environment, vibration and the like, the brightness sensor unit housing the brightness sensor does not receive adverse effects such as displacement in accordance with the displacement of the frame and bezel of the display panel body.

Also, the brightness sensor may be connected, via a flexible cable, to a brightness control portion that performs brightness adjustment of the display panel body.

Thereby, it is possible to prevent the transmission of deformation and displacement of the display panel body from the brightness control portion to the brightness sensor by absorbing it with the flexible cable.

Effect of the Invention

According to the present invention, by fixing the brightness sensor unit having the brightness sensor on the display surface of the display panel body, even if the display panel body undergoes deformation and displacement due to vibration and heat, there is no shifting of the brightness sensor unit from the adhesion position on the display surface. Thereby, even if there are temperature changes of the display device and temperature changes of the environment and the like, it is possible to perform detection of the brightness of the display surface by the brightness sensor with a high degree of accuracy without being affected by them.

Moreover, it is possible to perform highly accurate detection of the brightness by the brightness sensor without causing an enlargement or increase in weight of the display device, or a limitation of the information display area.

EMBODIMENTS FOR CARRYING OUT THE INVENTION

Figure 1:
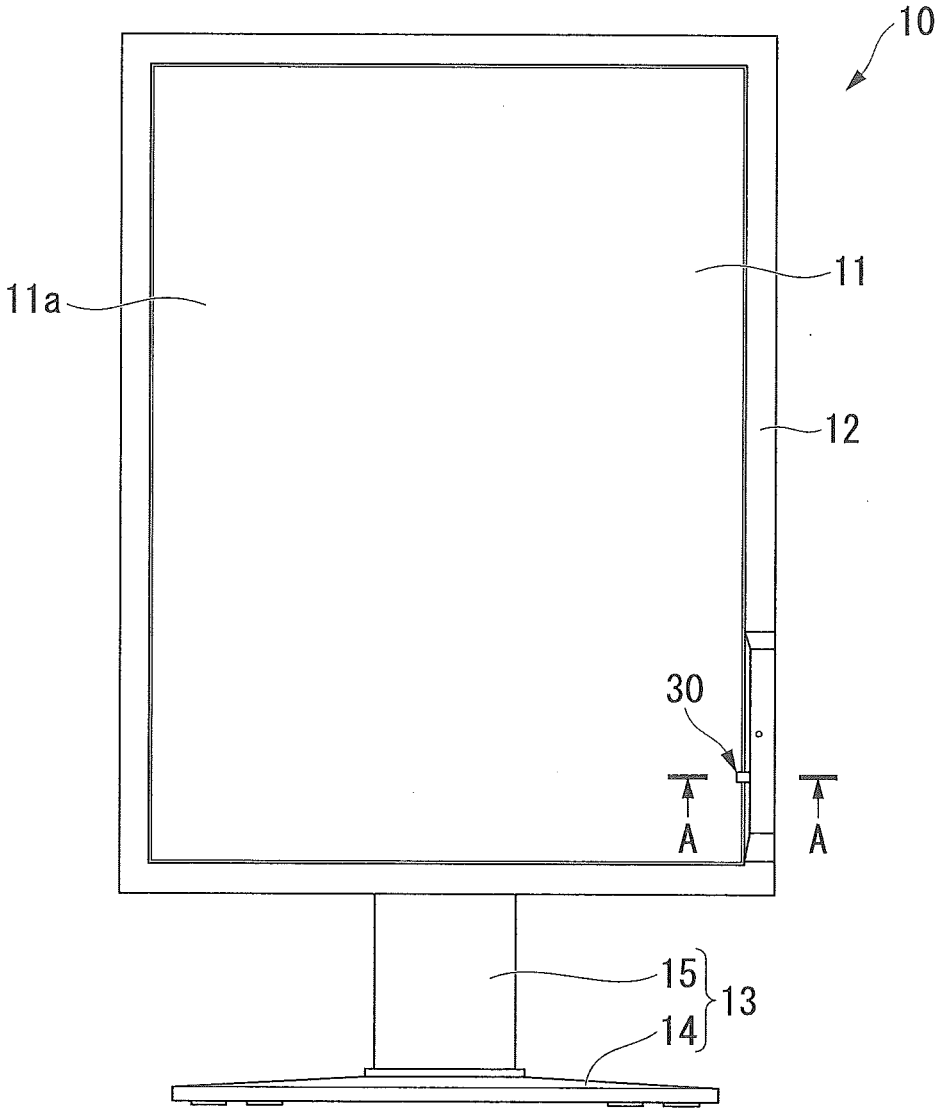
FIG. 1 is front elevation that shows an example of a display device according to an exemplary embodiment of the present invention.

Hereinbelow, display devices according to exemplary embodiments of the present invention shall be described, referring to the drawings. However, the present invention shall not be limited only to these exemplary embodiments.

As shown in FIG. 1, a display device 10 according to a present exemplary embodiment includes a display panel body 11 that includes a liquid crystal display panel or the like, a chassis 12 that incorporates the display panel body 11 and a control substrate including a drive circuit that drives this display panel main body 11, and a base member 13 that supports the chassis 12.

The base member 13 is constituted for example from a base plate 14 and a support column 15 that is provided on the base plate 14 and supports the chassis 12.

Figure 2:
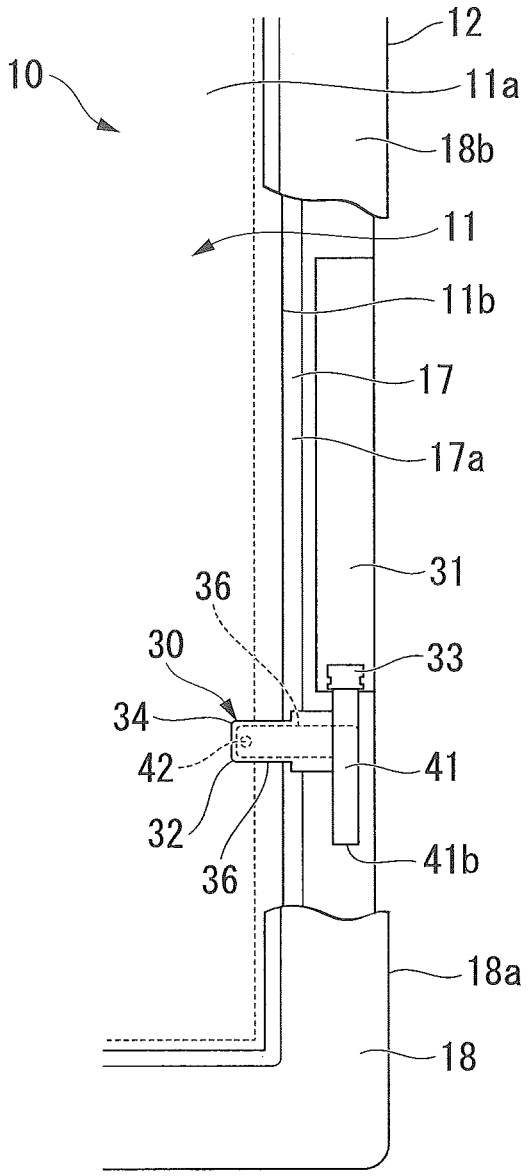
FIG. 2 is a partially cutaway enlarged view showing a brightness sensor provided in the display device shown in FIG. 1.
Figure 3:
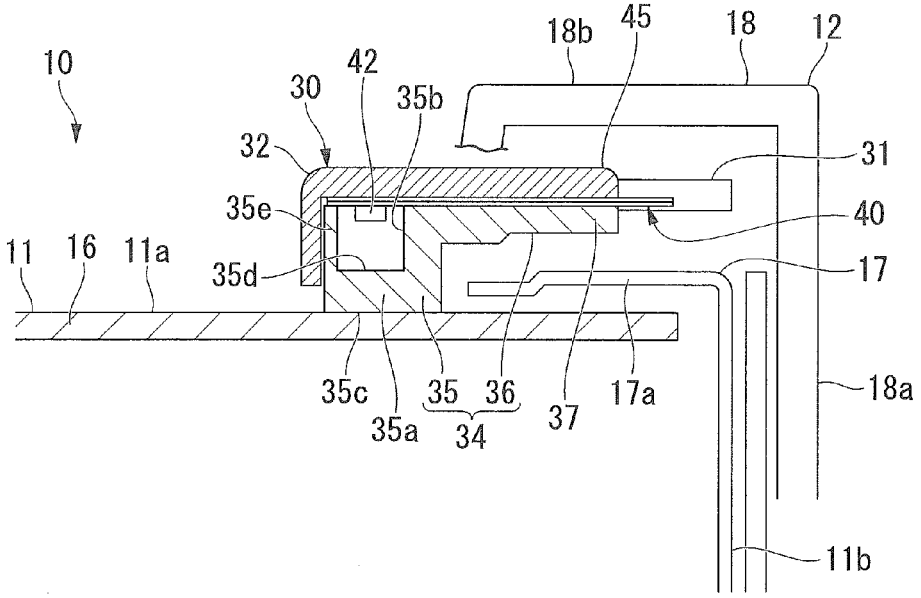
FIG. 3 is an enlarged cross-sectional view along line A-A of FIG. 1 showing a brightness sensor unit.

As shown in FIG. 2 and FIG. 3, in the display panel body 11, a display surface 11*a* thereof is formed by a transmissive panel. The outer periphery of this transmissive panel is covered by a panel frame 17 that forms an outer side surface 11*b* of the display panel body 11. This panel frame 17 has a pressing portion 17*a* that extends parallel to the display surface 11*a*, at the periphery portion of the display panel body 11.

The chassis 12 includes a back-surface housing not shown that covers the entire back surface of the display panel body 11, and a bezel 18 with a square frame shape that is fitted in the back surface housing and that closes the outer periphery portion of the display panel body 11 at the display surface 11*a* side of the display panel body 11.

This bezel 18 has an L-shaped cross-section, and has an outer peripheral wall portion 18*a* that is parallel with the outer side surface 11*b* of the display panel body 11, and fitted in the back surface housing, and a cover portion 18*b* that is perpendicular to the outer peripheral wall portion 18*a* and positioned parallel with the display surface 11*a* of the display panel body 11 and that covers the outer periphery of the display panel body 11. Here, the pressing portion 17*a* of the panel frame 17 and the cover portion 18*b* of the bezel 18 face each other with an interval therebetween.

In this kind of display device 10, a brightness sensor unit 30 is provided at the end portion of the display surface 11*a* of the display panel body 11.

Figure 5:
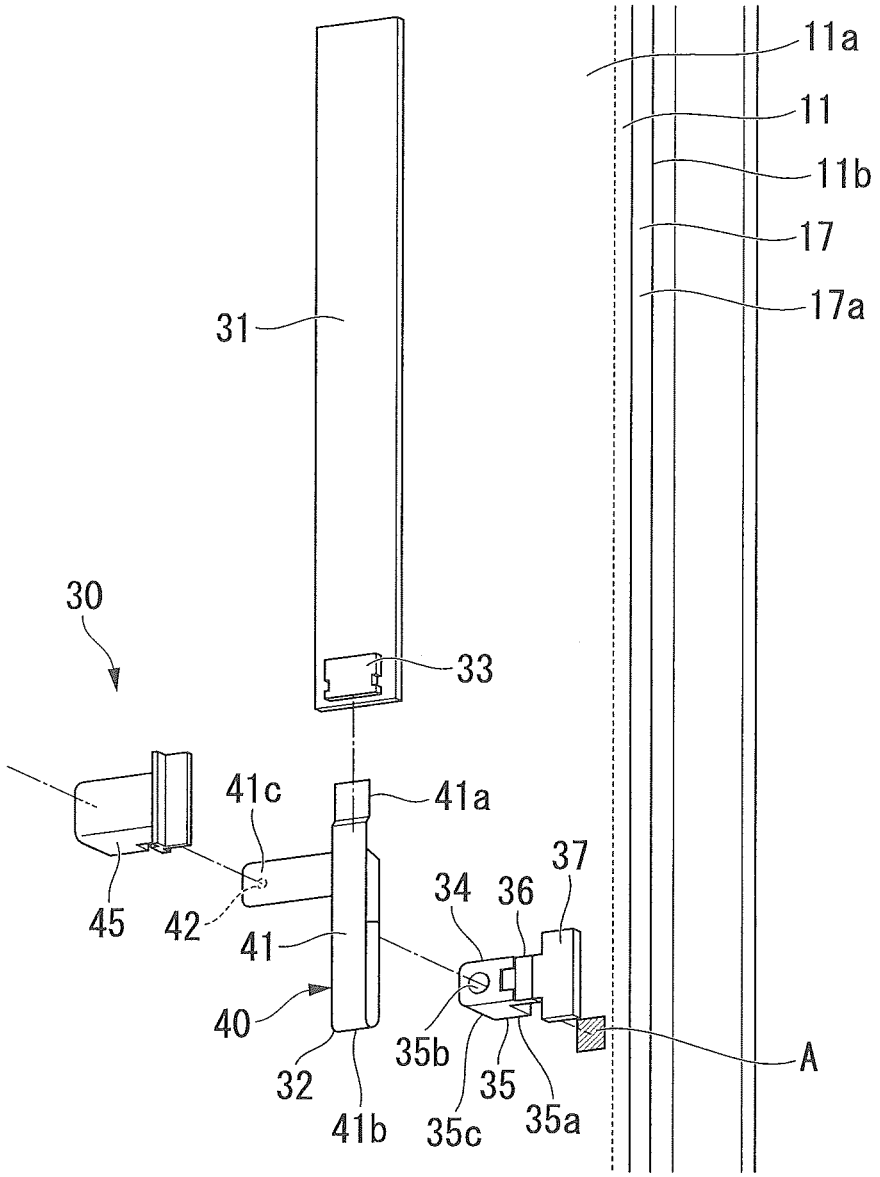
FIG. 5 is an exploded perspective view showing the constitution of the brightness sensor unit shown in FIG. 2.

As shown in FIG. 5, the brightness sensor unit 30 includes a substrate 31 that is provided above the pressing portion 17*a* of the panel frame 17, and a sensor body 32.

The substrate 31 constitutes a portion of the drive circuit of the display panel body 11, and is electrically connected to the main substrate and the like provided on the back surface side of the display panel body 11. A connector 33 for connecting the sensor body 32 is provided at the end portion of the substrate 31. The sensor body 32 has a sensor holder 34 that is fixed to the display surface 11*a* of the display panel body 11.

Figure 4:
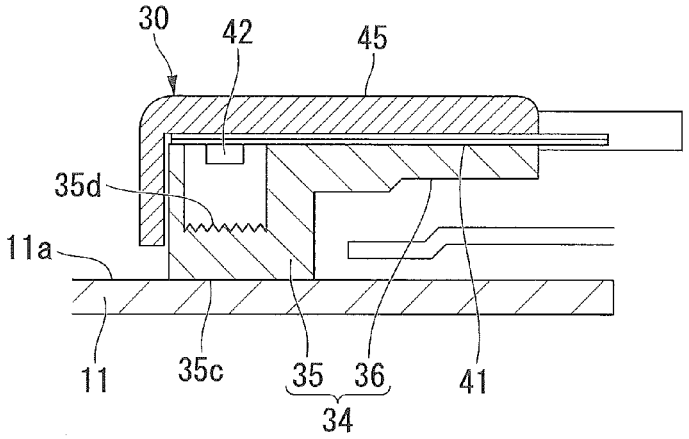
FIG. 4 is an enlarged view of the brightness sensor unit shown in FIG. 3.

As shown in FIG. 3 and FIG. 4, the sensor holder 34 is formed in an approximate L shape with a light transmissive material that is transparent or semi-transparent with such as a milky white color, and has a base portion 35 that is fixed to a specified position on the surface of the display panel body 11, and a stay portion 36 having a thin plate shape that extends from the base portion 35 toward the cover portion 18*b* of the bezel 18 in parallel with the display surface 11*a*.

The base portion 35 has an approximate bottomed cylindrical shape with a plate-shaped core portion 35*a* at the side of the surface adhered to the display surface 11*a* of the display panel body 11 and a cylindrical portion 35*e*, and the inner portion thereof serves as a housing cavity 35*b*. In the housing cavity 35*b*, a brightness sensor 42 that measures the brightness of the display surface 11*a* of the display panel body 11 is housed. In this base portion 35, the outer periphery surface including the cylindrical portion 35*e* is painted with a light-blocking paint or the like that does not transmit light. However, the bottom surface 35*c* is not painted.

The base portion 35 is fixed to the display surface 11*a* of the display panel body 11 by the bottom surface 35*c* being adhered to a position facing an area A where a specified display pattern for brightness detection is displayed.

As the fixing means of the base portion 35 to the display surface 11*a*, an adhesive or the like is used, with an ultraviolet ray (UV) cured adhesive being preferably used. There is a possibility of an ordinary solvent volatilization-type adhesive bleeding into the periphery until the solvent volatilizes, and the base portion 35 moving on the display surface 11*a* until the adhesive hardens.

In contrast, in the case of an ultraviolet ray cured adhesive, the adhesive hardens in a short time by UV radiation, and the base portion 35 can be adhesively fixed on the display surface 11*a* in a short time, which is desired. It is also possible to use double-sided tape instead of an adhesive. However, the adhesion capacity of double-sided tape is comparatively small, so when compensating for that a large adhesion surface area becomes necessary, leading to an enlargement of the base portion 35. By using an ultraviolet ray cured adhesive, it is possible to obtain sufficient adhesive strength with a smaller adhesion surface area, and so a reduction in the size of the base portion 35 is achieved, which is preferable.

Also, in the base portion 35, the inner surface 35*d* of the housing cavity 35*b* opposing the bottom surface 35*c* adhered to the display surface 11*a* is subjected to a light diffusion treatment to cause it to diffuse light as a light diffusing portion. This light diffusing portion is constituted by forming irregularities on the inner surface 35*d*. Note that the irregularities for light diffusion may also be formed on the bottom surface 35*c* that is adhered to the display surface 11*a*. In this case, the adhesive strength between the base portion 35 and the display surface 11*a* improves.

The stay portion 36 with a thin plate shape of the brightness sensor unit 30 extends from the base portion 35 toward the cover portion 18*b* of the bezel 18, and at the distal end portion thereof, an installation portion 37 is continuously formed in the direction along the outer periphery of the display panel body 11, perpendicular to the direction of extension of the stay portion 36. This sensor holder 34 has an approximate T shape as shown in FIG. 5, by the base portion 35, the stay portion 36 and the installation portion 37.

As shown in FIG. 3, the stay portion 36 and the installation portion 37 are provided so as to be positioned between the pressing portion 17*a* of the panel frame 17 and the cover portion 18*b* of the bezel 18, in a state of non-contact with both. The separation distance of the stay portion 36 and the installation portion 37 with the panel frame 17, and the separation distance of the stay portion 36 and the installation portion 37 with the bezel 18 is 1 to 2 mm. With this constitution, even if the panel frame 17 and the bezel 18 undergo expansion and contraction due to temperature changes, no adverse affect is imparted to the brightness sensor unit 30.

Also, as shown in FIG. 5, a sensor member 40 is attached on the installation portion 37 of this kind of sensor holder 34. The sensor member 40 has a flat cable (flexible cable) 41 with an approximate T shape in planar view supported on the installation portion 37 of the sensor holder 34, and the brightness sensor 42 that is mounted on the flat cable 41 to be held within the housing cavity 35*b* of the sensor holder 34.

One end 41*a* of the flat cable 41 is connected to the connector 33 of the substrate 31. The flat cable 41 is formed in an approximate T shape, so as to extend from one end 41*a* thereof in the opposite direction along the outer periphery of the display panel body 11, and after being folded back 180 degrees at a turnaround portion 41*b*, cross orthogonally to the outer periphery of the display panel body 11 on the installation portion 37 and extend toward the base portion 35 on the stay portion 36. Here, the flat cable 41 is fixed by double-sided tape on the installation portion 37.

As shown in FIG. 3 to FIG. 5, the brightness sensor 42 is provided at the other end 41*c* of the flat cable 41, and is disposed within the housing cavity 35*b* that is formed in the base portion 35.

In FIG. 4, the flat cable 41 of the sensor member 40 is sandwiched by the sensor holder 34 being arranged at one surface thereof, and a cover 45 that covers them being provided at the other surface. One end of the cover 45 is positioned between the cover portion 18*b* of the bezel 18 and the sensor member 40, and is disposed with a gap with respect to the bezel 18.

That is to say, except that the sensor holder 34 is fixed to the display surface 11*a* and the flat cable 41 that freely moves is connected with the connector 33 of the substrate 31, the brightness sensor unit 30 is not fixed to other sections and so can freely move. Thereby, the brightness sensor unit 30 is unaffected by displacement of the panel frame 17 or bezel 18 of the display panel body 11.

As shown in FIG. 5, the brightness sensor unit 30 described above measures the brightness of light of a specified display pattern for brightness detection that is shown in the area A on the display surface 11*a* of the display panel body 11, by the brightness sensor 42 that is fixed within the base portion 35 of the sensor holder 34. Then, in a brightness control portion not shown of the display device 10, the optical output of a light source such as a backlight that is provided on the back surface side of the display panel body 11 is adjusted based on an operation program that is defined in advance, in accordance with the measurement result by the brightness sensor 42. In accordance with the optical output of the light source at this time, brightness adjustment, adjustment of the gradation characteristic, and changes are automatically performed.

As stated above, according to the brightness sensor unit 30 of the display device 10 according to the present exemplary embodiment, the bottom surface 35*c* of the base portion 35 in the brightness sensor unit 30 is fixed by an ultraviolet ray cured adhesive onto the display surface 11*a* of the display panel body 11. Therefore, it is possible to maintain brightness detection accuracy at a high level without causing positional shifting with respect to the display surface 11*a* by temperature changes, heat or vibration, and without variations occurring in the brightness due to the positional shifting.

Consequently, since it is sufficient that the minimum surface area for brightness detection is secured on the display surface 11*a*, it is possible to secure to the maximum extent the effective information display area.

With this constitution, there is no enlargement of the brightness sensor unit 30, and no disadvantages arise such as an enlargement and increase in weight of the display device 10.

Moreover, in the brightness sensor unit 30, a light diffusing portion on which a light diffusion treatment is applied, is provided in the inner surface 35*d* of the housing cavity 35*b* in the base portion 35. Therefore, the light that is emitted from the display surface 11*a* passes through the core portion 35*a* of the base portion 35, is diffused by the light diffusing portion of the inner surface 35*c* of the housing cavity 35*b*, and reaches the brightness sensor 42. Accordingly, brightness measurement of greater stability can be performed.

Also, the brightness sensor unit 30 is provided so as to be positioned between the pressing portion 17*a* of the panel frame 17 and the cover portion 18*b* of the bezel 18 in a state of non-contact with both. Therefore, even if the panel frame 17 and bezel 18 undergo displacement or deformation due to heat and the like, it is possible to prevent positional shifting of the brightness sensor unit 30.

Here, it is possible to form the base portion 35 only with the cylindrical portion 35*e* having a cylindrical shape, without providing the core portion 35*a*. On the other hand, by connecting and sealing the plate-shaped core portion 35*a* as a bottom portion to the display surface 11*a* side of the cylindrical portion 35*e*, it is possible to secure an adhesion surface area to the display surface 11*a* of the display panel body 11 by the bottom portion 35*c* that is one surface of the core portion 35*a*, and it is possible to achieve a reduction in size of the brightness sensor 30.

Also, by forming the light diffusing portion having irregularities on the inner surface 35*d* opposing the bottom portion 35*c* to diffuse the incoming light, uniform and stable brightness measurements can be performed.

Moreover, since an ultraviolet ray (UV) cured adhesive is used for adhering the base portion 35 to the display surface 11*a* of the display panel body 11, attachment of the brightness sensor unit 30 can be quickly performed, and high-quality brightness measurement can be performed with bleeding of the adhesive prevented.

Other Exemplary Embodiments

The display device of the present invention is not limited to the aforementioned exemplary embodiment described referring to the drawings, and it is possible to apply various modifications and alterations without departing from the scope of the present invention.

For example, as a modified example, in addition to the inner surface 35*d* in the housing cavity 35*b* in the base portion 35, the light diffusing portion having irregularities may also be formed on the bottom surface 35*c* that is adhered to the display surface 11*a* of the display panel body 11. Thereby, the diffusion effect of light that is received by the brightness sensor 42 is doubled due to the light diffusing portion being formed on the bottom surface 35*c* and the inner surface 35*d*, that are both surfaces of the core portion 35*a*, and so more stable brightness measurements can be performed. Also, since the adhesive is filled in the irregular surface of the bottom surface 35*c*, it is possible to improve the adhesive strength of the brightness sensor unit 30 to the display surface 11*a* of the display panel body 11. Also, the light diffusing portion having irregularities may be formed only on the bottom surface 35*c*, which is the adhesion surface to the display surface 11*a*, instead of the inner surface 35*d*.

Figure 6:
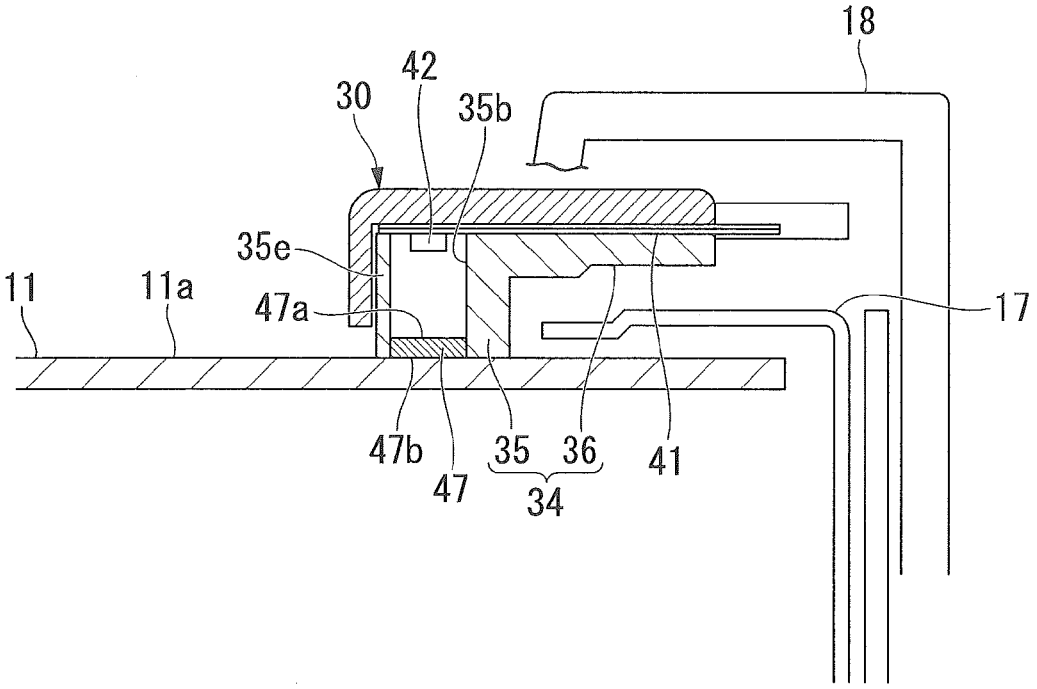
FIG. 6 is a similar figure to FIG. 3, showing a modified example of a brightness sensor unit.

FIG. 6 shows a modified example of the brightness sensor unit 30 according to the exemplary embodiment described above. In this modified example, the base portion 35 of the sensor holder 34, which houses the brightness sensor 42 that is fixed to the flat cable 41, has a cylindrical portion 35*e*. In the cylindrical portion 35*e* of the base portion 35, a plate-shaped light diffusing member 47 is fixed to the end portion facing the brightness sensor 42. The base portion 35 constitutes a housing cavity 35*b* that houses the brightness sensor 42 by the cylindrical portion 35*e* and the light diffusing member 47.

In this light diffusing member 47, a light diffusing material with fine particle diameters is distributively arranged in the interior. A light diffusing member having this kind of constitution is also included in the light diffusing portion.

Alternatively, a light diffusing portion by means of irregularities may be formed on the inner surface 47*a* of the brightness sensor 42 side in the light diffusing member 47 or the opposing surface 47*b*. The surface 47*b* that opposes the inner surface 47*a* of the light diffusing member 47 is made to serve as the adhesion surface to the display surface 11*a*.

Also, the constitution of the display device 10 itself is not limited at all, and the display format of the display panel body 11, the structure of the other parts and the like may have any other constitutions.

Furthermore, it is possible to implement a constitution in which the brightness sensor unit 30 itself is housed in the bezel 18 and that performs brightness detection by the portion that is covered with the bezel 18.

In addition, it is possible to selectively adopt or reject the constitutions given in the aforementioned exemplary embodiments, and suitably modify them to other constitutions to the extent of not departing from the scope of the present invention.

INDUSTRIAL APPLICABILITY

In the display device according to the present invention, a brightness sensor unit is fixed on the display surface of a display panel body, and in the brightness sensor unit a housing cavity that houses a brightness sensor is formed, a light diffusing portion is formed on the inner surface of the housing cavity facing the brightness sensor, and the bottom surface opposing the inner surface is adhered to the display surface. Thereby, it is possible to detect with high accuracy with the light diffusing portion the brightness of the display surface, without being affected by temperature changes, vibration and the like.

REFERENCE SYMBOLS

10: Display device
11: Display panel body
11*a*: Display surface
11*b*: Outer side surface
12: Chassis
13: Base member
14: Base plate
15: Support column
17: Panel frame
18: Bezel
30: Brightness sensor unit
31: Substrate
32: Sensor unit
34: Sensor holder
35: Base portion
35*a*: Core portion
35*b*: Housing cavity
35*c*: Bottom surface
35*d*: Inner surface
35*e*: Cylindrical portion
36: Stay portion
40: Sensor member
41: Flat cable (flexible cable)
42: Brightness sensor
45: Cover
47: Light diffusing member
A: Area

The invention claimed is:

1. A display device comprising:

a display panel body that has a display surface emitting light; and a brightness sensor unit that is fixed on the display surface of the display panel body, wherein the brightness sensor unit includes: a brightness sensor detecting a brightness of the light from the display surface; and a sensor holder comprising a light transmissive material, the sensor holder includes: an adhesion surface adhered to the display surface of the display panel body; and a light diffusing portion diffusing the light from the display surface, the brightness sensor is fixed to a position facing the display surface with sandwiching the light diffusing portion of the sensor holder between the brightness sensor and the display surface, wherein the sensor holder includes a base portion in which a housing cavity housing the brightness sensor is formed, and the light diffusing portion is provided on an inner surface of the housing cavity, the inner surface opposing the brightness sensor.

2. The display device according to claim 1, wherein the light diffusing portion comprises a surface opposing the adhesion surface, and the surface of the diffusing portion comprises irregularities.

3. The display device according to claim 1, wherein the light diffusing portion comprises a light diffusing member that contains a light diffusing material.

4. The display device according to claim 1, wherein the sensor holder is separate from a frame and a bezel provided at an outer periphery of the display panel body.

5. The display device according to claim 1, wherein the brightness sensor is connected, via a flexible cable, to a brightness control portion that performs brightness adjustment of the display panel body.

* * * * *